US012241188B2

(12) United States Patent
Colosio et al.

(10) Patent No.: US 12,241,188 B2
(45) Date of Patent: Mar. 4, 2025

(54) PROCESS FOR REALIZING AN UPPER FOR SHOES AND AN UPPER FOR A SHOE

(71) Applicant: JVC HOLDING S.R.L., Rezzato (IT)

(72) Inventors: Gianfranco Colosio, Rezzato (IT); Paolo Lenzi, Rezzato (IT)

(73) Assignee: JVC HOLDING S.R.L., Rezzato (IT)

( * ) Notice: Subject to any disclaimer, the term of this patent is extended or adjusted under 35 U.S.C. 154(b) by 673 days.

(21) Appl. No.: 16/491,931

(22) PCT Filed: Mar. 6, 2018

(86) PCT No.: PCT/EP2018/055495
§ 371 (c)(1),
(2) Date: Sep. 6, 2019

(87) PCT Pub. No.: WO2018/162494
PCT Pub. Date: Sep. 13, 2018

(65) Prior Publication Data
US 2021/0148018 A1 May 20, 2021

(30) Foreign Application Priority Data
Mar. 8, 2017 (IT) ..... 102017000025731

(51) Int. Cl.
*D04B 9/20* (2006.01)
*D04B 1/24* (2006.01)
*D04B 9/22* (2006.01)

(52) U.S. Cl.
CPC ..... *D04B 9/20* (2013.01); *D04B 1/24* (2013.01); *D04B 9/22* (2013.01); *D10B 2501/043* (2013.01)

(58) Field of Classification Search
CPC ... D04B 9/00; D04B 9/20; D04B 9/22; D04B 9/36; D04B 9/38
(Continued)

(56) References Cited

U.S. PATENT DOCUMENTS 431,292 A * 7/1890 Sullivan ..... D04B 13/00 66/79
632,872 A * 9/1899 Lahser et al. ..... D04B 9/20 66/106

(Continued)

FOREIGN PATENT DOCUMENTS

WO 2005/092134 A1 10/2005
WO 2009/117976 A1 10/2009
WO WO-2015078817 A1 * 6/2015 ..... D04B 1/126

OTHER PUBLICATIONS

Abedin, F et al. "Effect of Gauge Variation of Circular Knitting Machine on Physical and Mechanical Properties of Cotton Knitted Fabrics." International Journal of Textile Science 2014 (3)4: 70-75. DOI: 10.5923/j.textile.20140304.03. https://vixra.org/pdf/1506.0030v1.pdf. (Year: 2014).*

(Continued)

*Primary Examiner* — Grace Huang
(74) *Attorney, Agent, or Firm* — Troutman Pepper Locke LLP

(57) ABSTRACT

The process for realizing an upper for shoes consists of using at least a first and second group of needles of a needle-bearing cylinder of a circular knitting machine, each needle of said first group and of said second group of needles being used in a tuck stitch or loop position and/or in a plain drop stitch position and/or in a missed stitch position at least during the forward rotation of said needle-bearing cylinder, said at least first and second group of needles being used alternatively in said at least forward rotation of said needle-bearing cylinder so as to knit several yarns together without having to continuously cut them.

4 Claims, 10 Drawing Sheets

(58) Field of Classification Search
USPC ..... 66/51
See application file for complete search history.

(56) References Cited

U.S. PATENT DOCUMENTS

| | | | | | |
|---|---|---|---|---|---|
| 1,077,370 | A * | 11/1913 | Robinson | D04B 1/26 | 66/169 A |
| 1,140,709 | A * | 5/1915 | Paxton et al. | D04B 9/18 | 66/111 |
| 1,192,801 | A * | 7/1916 | Scott | D04B 9/54 | 66/173 |
| 1,402,379 | A * | 1/1922 | Robinson | D04B 9/38 | 66/44 |
| 1,428,939 | A * | 9/1922 | Bosworth | D04B 9/58 | 66/174 |
| 1,605,895 | A * | 11/1926 | Lawson | D04B 9/26 | 66/146 |
| 1,673,095 | A * | 6/1928 | Stroud | D04B 9/06 | 66/93 |
| 1,721,390 | A * | 7/1929 | Hadfield | D04B 1/26 | 66/169 A |
| 1,727,586 | A * | 9/1929 | Condon | A43B 23/28 | 2/6 |
| 1,974,473 | A * | 9/1934 | Sheppard | D04B 1/26 | 66/57 |
| 1,995,262 | A * | 3/1935 | Lawson | D04B 1/26 | 66/172 R |
| 2,047,724 | A * | 7/1936 | Zuckerman | A43B 1/04 | 36/11 |
| 2,181,105 | A * | 11/1939 | Sirmay | D04B 9/28 | 66/25 |
| 2,215,286 | A * | 9/1940 | Davis, Jr. | D04B 35/04 | 66/41 |
| 2,217,022 | A * | 10/1940 | Lawson | D04B 15/74 | 66/146 |
| 2,291,576 | A * | 7/1942 | Booton | D04B 9/46 | 66/184 |
| 2,370,449 | A * | 2/1945 | Clarke | D04B 1/26 | 66/93 |
| 2,693,094 | A * | 11/1954 | Marlette | D04B 1/126 | 66/42 A |
| 3,013,416 | A * | 12/1961 | Fregeolle | D04B 1/26 | 66/48 |
| 3,015,942 | A * | 1/1962 | Fregeolle | A41B 11/00 | 66/186 |
| 3,046,762 | A * | 7/1962 | Shelmire | D04B 9/46 | 66/42 A |
| 3,085,410 | A * | 4/1963 | Loizillon | D04B 1/26 | 66/172 R |
| 3,173,278 | A * | 3/1965 | Kaylor | D04B 1/26 | 66/172 R |
| 3,222,890 | A * | 12/1965 | Fregeolle | D04B 9/26 | 66/43 |
| 3,884,052 | A * | 5/1975 | Findlay | D04B 9/54 | 66/187 |
| 4,057,981 | A * | 11/1977 | Runac | D04B 1/26 | 66/185 |
| 4,467,626 | A * | 8/1984 | Coble | A41B 11/02 | 66/196 |
| 4,644,762 | A * | 2/1987 | Hacker | D04B 9/20 | 66/51 |
| 5,095,719 | A * | 3/1992 | Philip | D04B 15/32 | 66/8 |
| 5,345,638 | A * | 9/1994 | Nishida | A43D 111/00 | 36/45 |
| 7,347,011 | B2 * | 3/2008 | Dua | A43D 111/00 | 36/3 A |
| 7,389,657 | B2 * | 6/2008 | Lonati | D04B 1/104 | 66/215 |
| 7,458,237 | B2 * | 12/2008 | Lonati | D04B 1/106 | 66/8 |
| 7,738,991 | B2 * | 6/2010 | Klumpp | D04B 1/26 | 66/185 |
| 9,084,449 | B2 * | 7/2015 | Bell | A43B 1/04 | |
| 9,775,401 | B2 * | 10/2017 | Cross | D04B 1/16 | |
| 9,820,530 | B2 * | 11/2017 | Cross | A43B 13/22 | |
| 9,968,156 | B2 * | 5/2018 | Huffman | A43B 23/042 | |
| 10,435,825 | B2 * | 10/2019 | MacGilbert | D04B 1/123 | |
| 10,718,075 | B2 * | 7/2020 | Lonati | D04B 9/10 | |
| 10,876,231 | B2 * | 12/2020 | Idobata | D04B 1/24 | |
| 10,889,923 | B2 * | 1/2021 | Diaz | A41D 27/28 | |
| 11,109,641 | B2 * | 9/2021 | Bell | A43B 23/026 | |
| 11,166,517 | B2 * | 11/2021 | Hoying | A43B 23/042 | |
| 11,291,268 | B2 * | 4/2022 | Wardlaw | A43B 13/181 | |
| 11,492,734 | B2 * | 11/2022 | Lonati | A43B 1/04 | |
| 2005/0115284 | A1 * | 6/2005 | Dua | A43B 23/042 | 66/178 R |
| 2016/0340811 | A1 * | 11/2016 | Roe | D04B 1/12 | |
| 2018/0317592 | A1 * | 11/2018 | Rudolf | A43B 7/12 | |
| 2020/0190712 | A1 * | 6/2020 | Colosio | D04B 1/108 | |
| 2020/0308738 | A1 * | 10/2020 | Lineberry | D04B 1/265 | |
| 2021/0106098 | A1 * | 4/2021 | Kajiwara | A43B 1/04 | |
| 2021/0324553 | A1 * | 10/2021 | Lonati | D04B 1/102 | |

OTHER PUBLICATIONS

Knitsbyjenn. "Knitting the Drop Stitch." Roving Crafters. May 29, 2016. http:/rovingcrafters.com/2016/05/29/knitting-the-drop-stitch/ (Year: 2016).*

Francis, N et al. "Chapter 3: Knitted Textile Design." Textile Design: Principles Advances and APplications. Woodhead Publishing Series in TExtiles. 2011, pp. 55-85, 86e-87e. (Year: 2011).*

"Just sit on it." POP!furniture on Wordpress. Mar. 8, 2015. https://popfurniture.wordpress.com/tag/bridle-stitch/#:~:text=The%20bridle%20stitch%20is%20a,run%2C%20it%20makes%20it%20adjustable. (Year: 2015).*

International Search Report and Written Opinion issued in corresponding International Patent Application No. PCT/EP2018/055495 dated Nov. 11, 2018.

* cited by examiner

PROCESS FOR REALIZING AN UPPER FOR SHOES AND AN UPPER FOR A SHOE

CROSS-REFERENCE TO RELATED APPLICATIONS

This Application is a National Stage of International Application No. PCT/EP2018/055495 filed Mar. 6, 2018, which published in English on Sep. 13, 2018 as WO 2018/162494 and claims priority to Italian Application No. 102017000025731 filed Mar. 8, 2017. All of the above applications are incorporated herein by reference in their entirety.

FIELD OF THE INVENTION

The present invention relates to a process for realizing an upper for shoes.

BACKGROUND

As is known, there are currently numerous types of shoes on the market, prevalently sports shoes, comprising a knitted upper.

Such shoes have rapidly conquered the market, thanks to their comfort and casual style, therefore they are also worn for free time, perfectly combining the advantages of practicality with those of fashion.

The knitting process of the upper allows various types of shoes having different technical characteristics from each other to be produced, which make them suitable for any user.

The technique used for producing the knitted upper, processed with a rectilinear knitting machine further envisages the use of a single yarn, for reducing the seams and the weight, and allowing maximum lightness of the upper.

However, following the formation of the upper, it must be subjected to numerous manual processes and requires numerous connection points for its association with a sole.

In fact, the upper produced in the rectilinear knitting machine does not exit already shaped but requires a further step for cutting off the excess yarn with the consequence of further increasing production times and costs.

Furthermore, even if the result obtained is a very light upper, the latter requires further seams so as to close it for the purpose of containing the user's foot in the area delimited by the sole.

The production times of a knitted upper on a rectilinear knitting machine are still fairly long as they vary from an average of 25 minutes to 45 minutes.

SUMMARY

The task set by the present invention is that of obtaining a process for realizing an upper for shoes that overcomes the mentioned disadvantages of the prior art.

Within the scope of this task, an object of the invention is that of obtaining a process for realizing an upper for shoes that is perfectly closed, shaped and ready to be connected to a sole for making a complete shoe.

It is yet another object of the invention to design a process for realizing an upper for shoes with extremely reduced times and costs with production waste substantially eliminated with respect to knitted uppers of the prior art.

It is yet another object of the invention to design a process for realizing an upper for shoes that provides the possibility to knit several yarns without ever having to cut them continuously.

It is yet another object of the invention to design a process for realizing an upper for shoes that simultaneously allows three-dimensional pouches for containing the tip and heel of the user's foot.

It is yet another object of the invention to design a process for realizing an upper for shoes that allows, amongst other things, the simultaneous realization of slots for the passage of laces, the laces themselves, a protective tongue and the heel-counter cover.

It is yet another object of the invention to design a process for realizing an upper for shoes that also allows a counter-upper to be realized simultaneously with the upper.

It is yet another object of the invention to design a process for realizing an upper for shoes that advantageously allows, according to the type of sole to which the upper will be connected, a closure thereof with the axis aligned with the axis of the sole so as to remain totally covered by the latter.

These objects and still others, which will become more apparent below, are substantially achieved by a process for realizing an upper for shoes, characterized in that it uses at least a first and second group of needles of a needle-bearing cylinder of a circular knitting machine, each needle of said first group and of said second group of needles being used in a tuck stitch or loop position and/or in a jersey stitch position and/or in a missed stitch position at least during the forward rotation of said needle-bearing cylinder, said at least first and second group of needles being used alternatively in said at least forward rotation of said needle-bearing cylinder so as to knit several yarns together without having to continuously cut them.

The process for realizing a tip of an upper for shoes further comprises, during the formation of the tip of the upper, realizing at least one opening for arranging a seam of the tip of the upper aligned with an axis of a sole to which the upper is to be anchored, said opening longitudinally developing in the area of the upper delimited by the sole along a center line axis of said area oriented from the tip to a heel of the upper. Furthermore, when the second plurality of the alternate forward and return rotations is performed, the number of needles in the jersey stitch position decreases and the number of needles in the missed stitch position on both sides of the left hand portion of the tip and on both sides of the right hand portion of the tip increases.

The subject matter of the present invention is also the characteristics set forth in the subordinate claims and in particular the fact that during the return rotation of said needle-bearing cylinder at least a third and a fourth group of needles are used, each needle of said third group and of said fourth group of needles being used in said tuck-stitch or loop position and/or in said jersey stitch position and/or in said missed or bridle stitch position, said at least a third and fourth group of needles being used alternatively in said return rotation of said needle-bearing cylinder.

The first group of needles and/or said second group of needles are respectively identical to said third and/or said fourth group of needles or are respectively different.

At least the first and second group of needles, during the formation of said upper, realize at least one three-dimensional pouch for containing the tip and/or the heel of the user's foot, the slots for the laces and the tying laces thereof, a protective tongue for protecting the user's foot from the tension of the laces, an elastic zone made using an elastic yarn, the join between the various processed parts of the upper, a heel-counter cover and additional holes at least for anchoring said upper to a sole or to any internal lining of said upper.

Advantageously, furthermore, the needles of said groups of needles, during the formation of said upper, realize at least one seam of the tip of the upper aligned with the axis of the sole itself thanks to the fact that the number of needles can increase or decrease at each change of direction of said needle-bearing cylinder.

The present invention further comprises a method for realizing a tip of an upper for shoes. The method comprises using at least a first group and a second group of needles of a needle-bearing cylinder of a circular knitting machine to respectively knit a left hand portion of the tip using a left hand yarn and a right hand portion of the tip using a right hand yarn, each needle of said first group and of said second group of needles being used in a jersey stitch position and/or in a missed or bridle stitch position at least during a forward rotation of said needle-bearing cylinder.

The method further comprises a joining between the left hand portion of the tip and the right hand portion of the tip made by one and the same needle in the jersey stitch position, the one and the same needle passing from the first group to the second group, or vice versa, at each change of rotation direction of said needle-bearing cylinder, the needle-bearing cylinder performing at least a first plurality of alternate forward and return rotations.

The method further comprises, during the formation of the tip of the upper, realizing at least one opening for arranging a seam of the tip of the upper aligned with an axis of a sole to which the upper is to be connected, said opening longitudinally developing in the area of the upper delimited by the sole along a center line axis of said area oriented from the tip to a heel of the upper. The method further comprises obtaining at least one opening with one and the same needle in the missed or bridle stitch position at each change of rotation direction of said needle-bearing cylinder when the needle-bearing cylinder performs a second plurality of alternate forward and return rotations and with respective needles of the first group and the second group of needles that are adjacent to the one and the same needle and are in the missed or bridle stitch position. When the second plurality of the alternate forward and return rotations is performed, the number of needles in the jersey stitch position decreases and the number of needles in the missed or bridle stitch position on both sides of the left hand portion of the tip and on both sides of the right hand portion of the tip increases.

BRIEF DESCRIPTION OF THE DRAWINGS

Additional features and advantages will become more apparent from the description of preferred but non-exclusive embodiments of the invention that are illustrated by way of indicative and non-limiting example in the appended drawings, in which.

DETAILED DESCRIPTION

Figure 1:
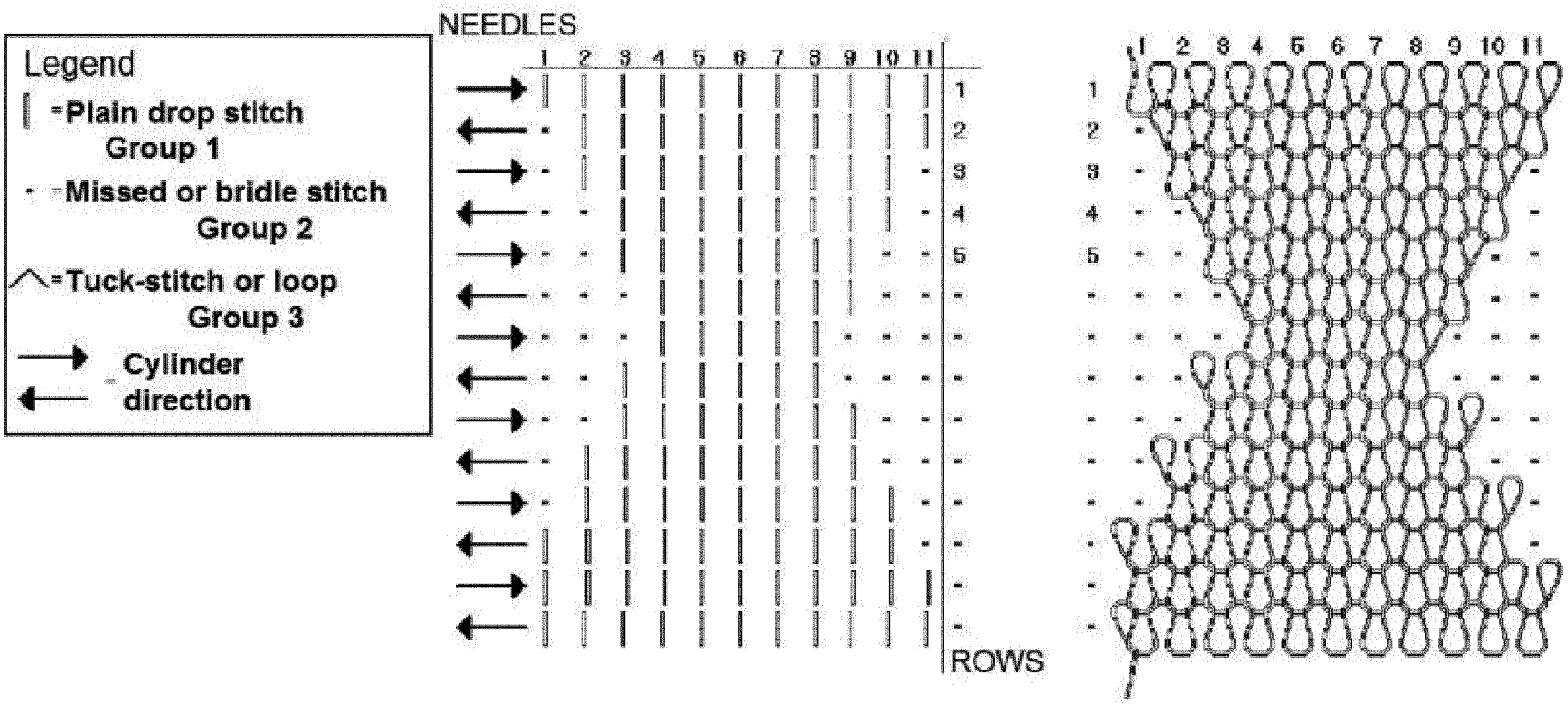
FIG. 1 is a schematic view of the knitting process and of the needles used for its formation in the realization of the pouch for the heel and the tip according to the present invention.

With particular reference to the figures described above, the process for realizing an upper 1 for shoes 2, according to the invention, uses at least a first and a second group of needles 3 and 4 of a needle-bearing cylinder 5 of a circular knitting machine not shown.

Advantageously, each needle of the first group 3 and of the second group 4 of needles is used in a tuck-stitch or loop position and/or in a plain drop stitch position and/or in a missed or bridle stitch position during the forward rotation of the needle-bearing cylinder 5.

During this forward rotation of the needle-bearing cylinder the first and second group of needles 3 and 4 are used one alternatively to the other so as to be able to knit several yarns together without having to continuously cut them and, therefore, providing the possibility to be able to perform further processes at the same time as the formation of the upper, as will be highlighted below.

The above allows a substantial amount of time to be saved for realizing an upper, eliminating most of the manual processes with respect to processes of the known type.

Furthermore, the upper thus produced, right after being knitted, is ready for fixing to the sole 6 of the shoe 2.

Advantageously, during the return rotation of the needle-bearing cylinder 5 at least a third and a fourth group of needles 7 and 8 are used.

Also in this case, each needle of the third and fourth group of needles 7 and 8 is used in a tuck-stitch or loop position and/or in a plain drop stitch position and/or in a missed or bridle stitch position.

Also in this case the third and fourth group of needles 7 and 8 are used alternatively during the return rotation of the needle-bearing cylinder 5.

Obviously in the return step of the needle-bearing cylinder, the third group of needles 7 selected may be the same or different or partially different from the first and/or second group of needles 3 and 4.

The same is also valid for the fourth group of needles 8 or for a fifth or sixth group of needles.

As represented in FIG. 1 the needles of the first and second groups of needles 3 and 4, during the formation of the upper 1, realize at least one three-dimensional pouch 10 for containing the tip and/or the heel of the user's foot.

During the formation of the pouch 10 the needles of the first group of needles 3 are in a drop stitch position and take the yarn for knitting said pouch while the needles of the second group of needles 4 are in a missed or bridle position and do not take part in the creation of the pouch 10 and can be increased or decreased at each change of direction of the needle-bearing cylinder.

Figure 2:
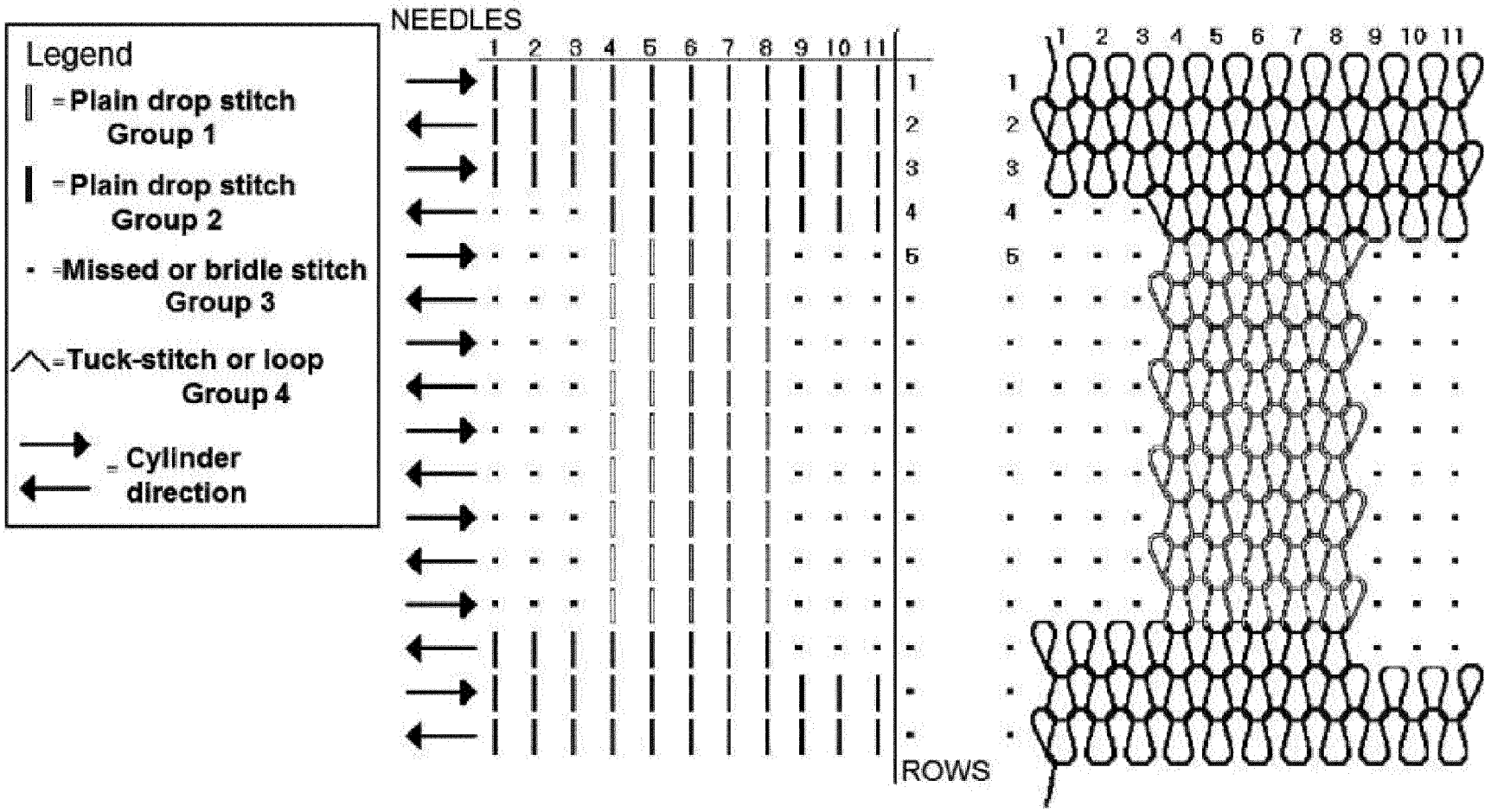
FIG. 2 is a schematic view of the knitting process and of the needles used for its formation in the realization of the slot according to the present invention.

As represented in FIG. 2 the needles of the first and second groups of needles 3 and 4, during the formation of the upper, realize at least the slots 20 for the laces thereof.

During the formation of the slots 20 the needles of the first group of needles 3 are in position for creating the knitting of the upper without ever increasing the number of needles used while the needles of the second group of needles 4 work previously and subsequently to the processing of the slots themselves and comprise the needles used for the formation of the slots and the needles used in the other zones of the upper.

Figure 3:
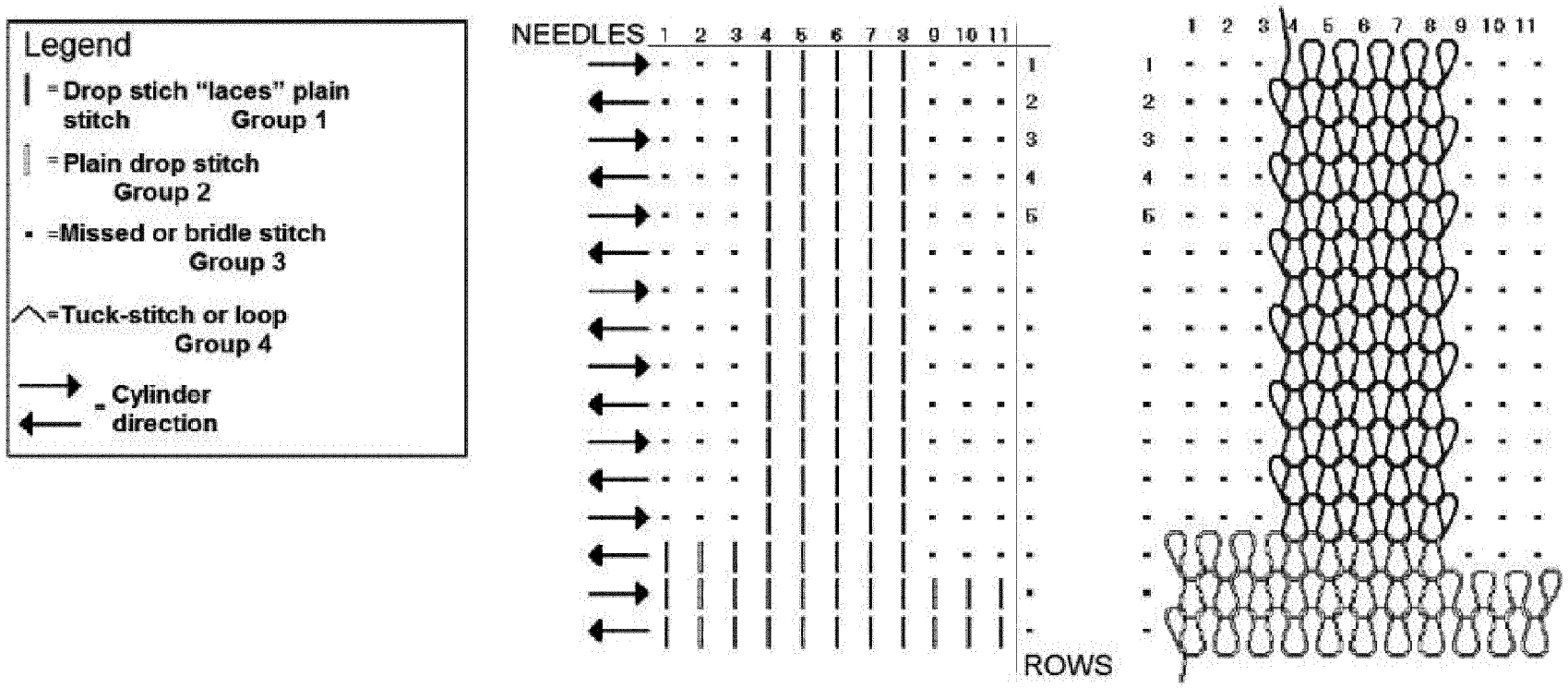
FIG. 3 is a schematic view of the knitting process and of the needles used for its formation in the realization of the laces according to the present invention.

As represented in FIG. 3 the needles of the first and second groups of needles, during the formation of the upper, realize at least the tying laces 30 thereof.

In particular, during the formation of the laces, the needles of the first group of needles 3 are determined by the width of each lace and create the knitting without ever increasing the number of needles used for all the rows necessary, represented in FIG. 3, for reaching the desired length of each lace 30.

During the formation of the laces 30 the needles of the second group of needles 4 fix the end of each of the laces to the upper.

Figure 4:
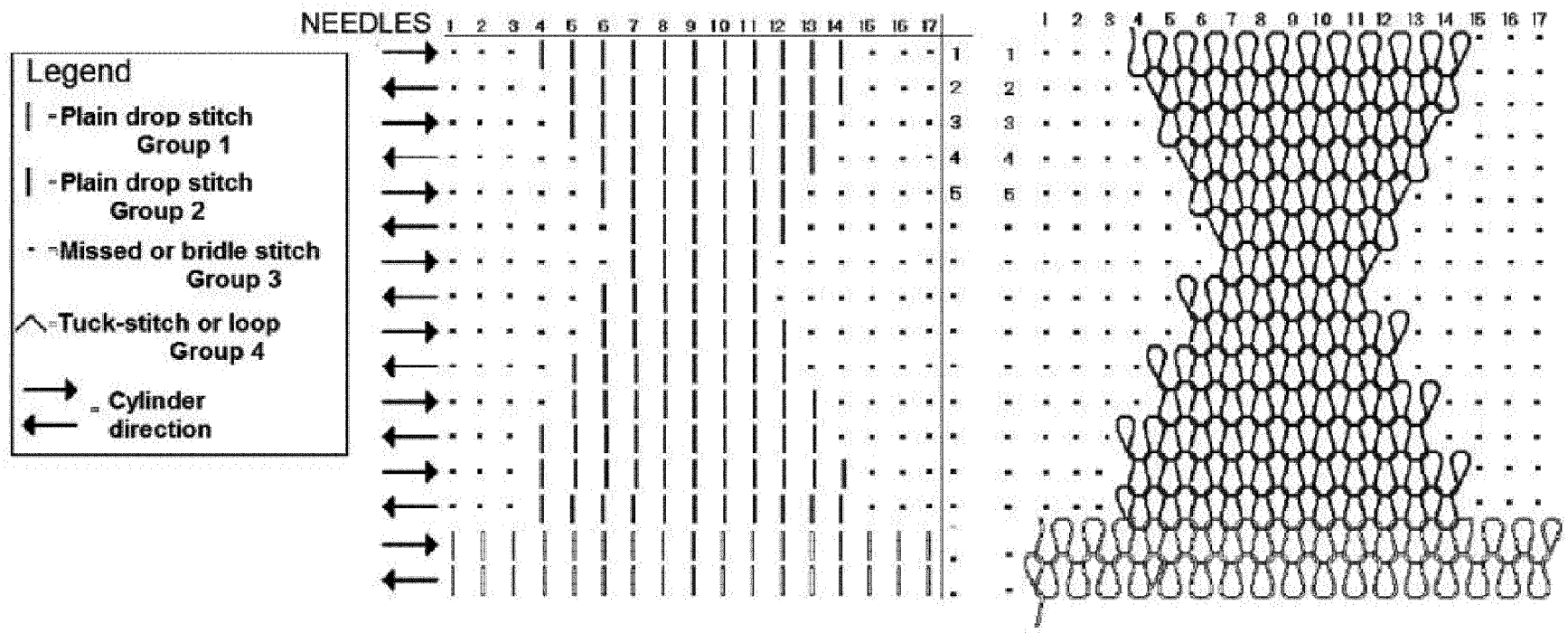
FIG. 4 is a schematic view of the knitting process and of the needles used for its formation in the realization of a comfortable tongue according to the present invention.

As represented in FIG. 4 the needles of the first and second group of needles, during the formation of the upper, realize a protective tongue 40 for protecting the user's foot from the tension of the laces 30 and allowing the user to widen the passage of the upper for inserting the user's foot therein.

During the formation of the protective tongue 40 the needles of the first group of needles 3 are in a drop stitch position for connecting the tongue to the upper while the needles of the second group of needles 4 are in a drop stitch position and take the yarn for knitting the tongue.

The second group of needles, during this step, increases or decreases at each change of direction of the needle-bearing cylinder 5 to determine the dimensions of the tongue.

Figure 5:
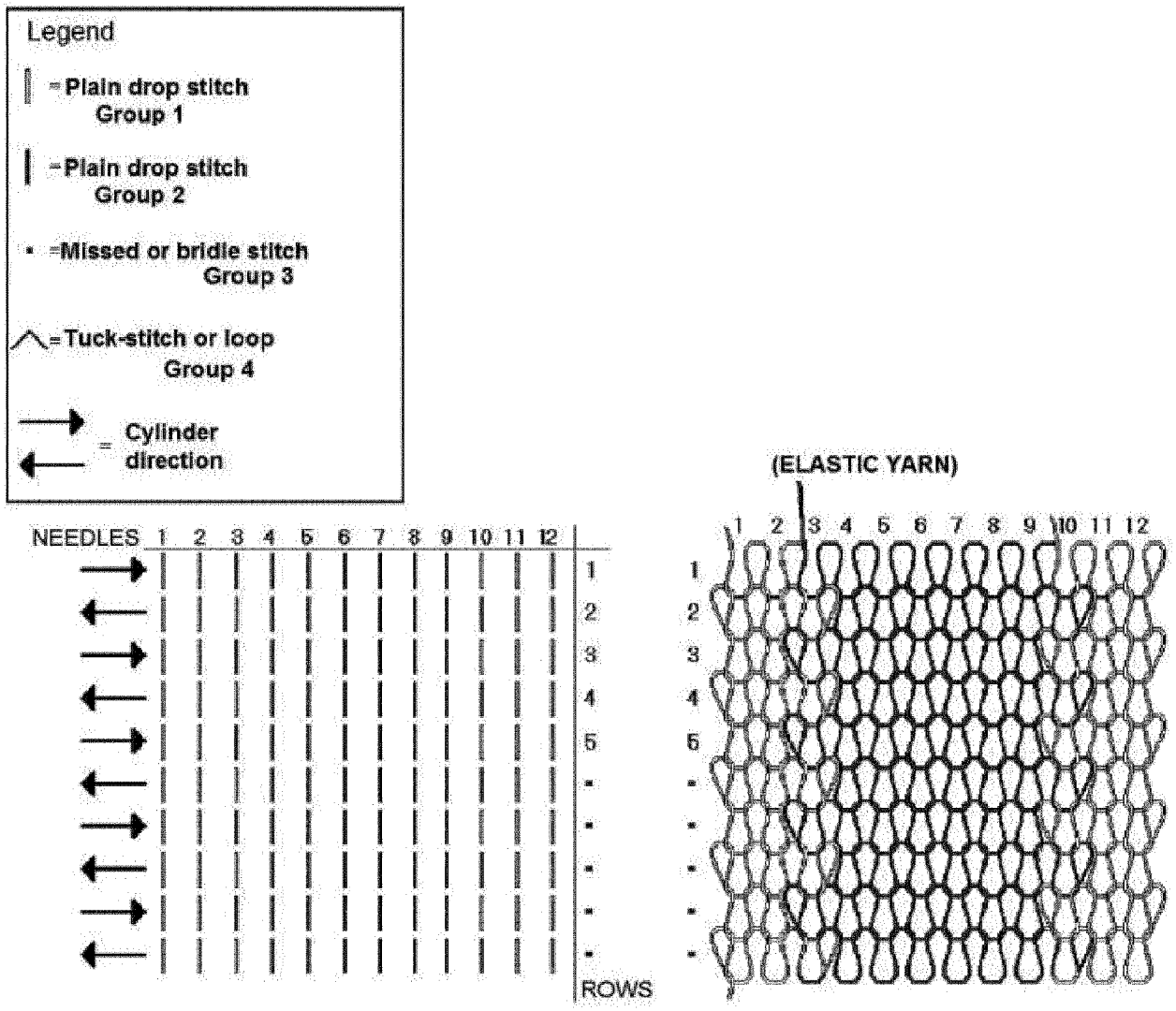
FIG. 5 is a perspective schematic view of the knitting process and of the needles used for its formation in the realization of an elastic zone according to the present invention.

As represented in FIG. 5 the needles of the first and second group of needles 3 and 4, during the formation of the upper, realize an elastic zone 50 made using an elastic yarn.

During the formation of the elastic zone the needles of the first group of needles 3 comprise needles to the right and left of the elastic zone 50.

Simultaneously, the needles of the second group of needles 4 knit with said elastic yarn.

Figure 6:
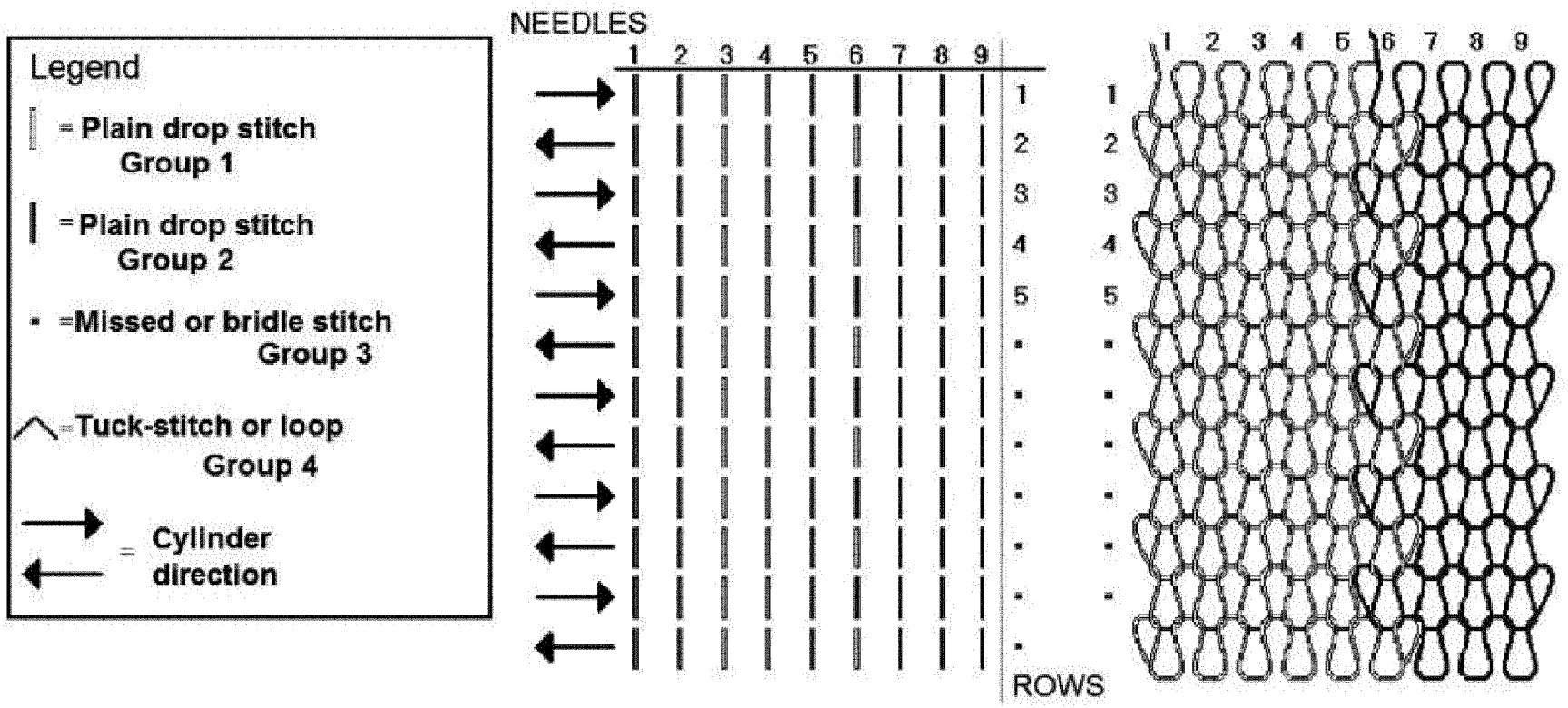
FIG. 6 is a perspective schematic view of the knitting process and of the needles used for its formation in the realization of a join between the various processed parts of the upper according to the present invention.

Advantageously, the needles of the first and second group of needles 3 and 4 can increase or decrease at each inversion of direction of the needle-bearing cylinder. As represented in FIG. 6 the needles of the first and second group of needles, during the formation of the upper, realize at least the join 60 between the various processed parts of the upper with alternating motion allowing the various knitting groups without cutting the yarns.

During the formation of the join 60 the needles of the first group of needles 3 are in a drop stitch position and rise to take the yarn of the right-hand process while the needles of the second group of needles 4 are also in a drop stitch position but rise to take the left-hand yarn.

Figure 7:
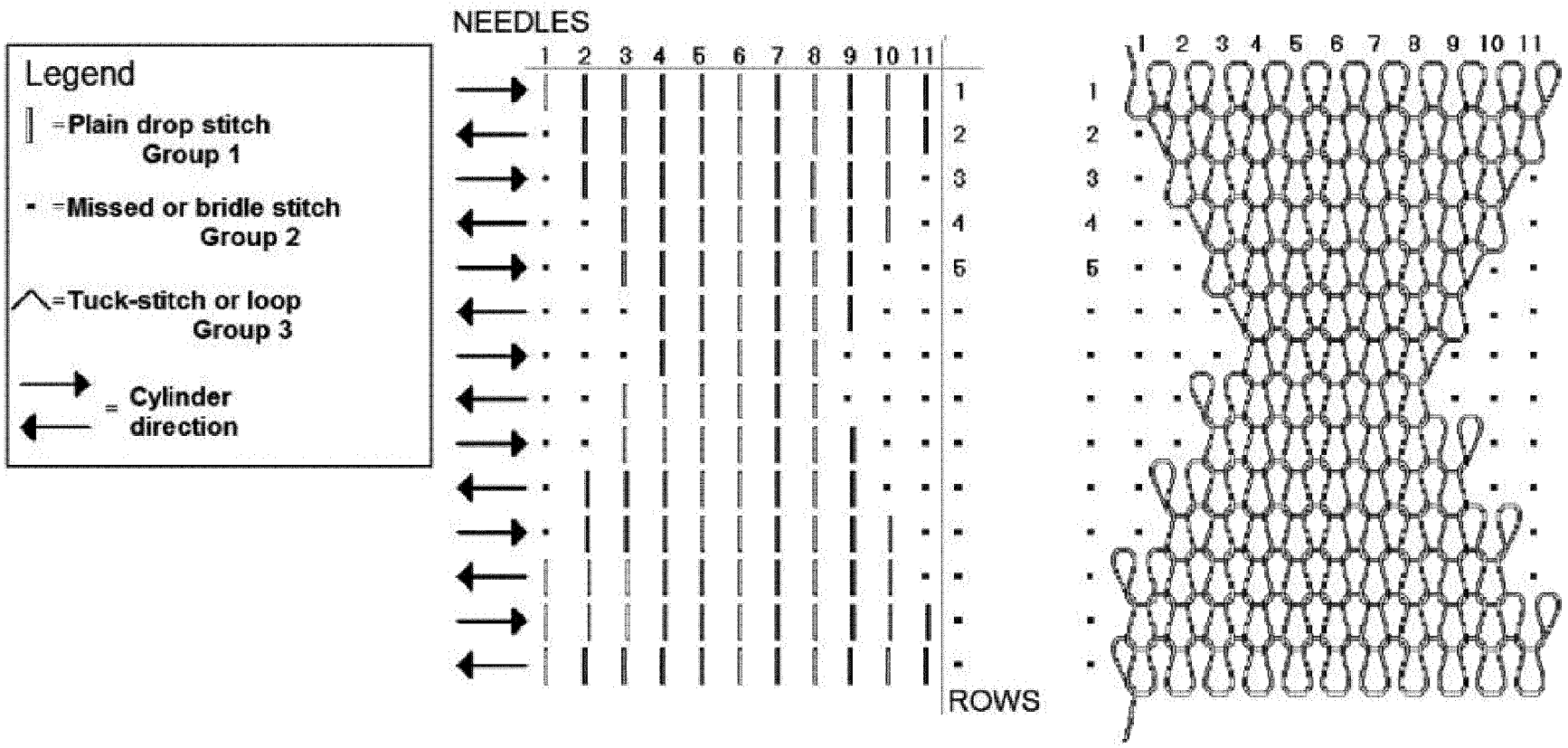
FIG. 7 is a perspective schematic view of the knitting process and of the needles used for its formation in the realization of a heel-counter cover according to the present invention.

Also in this case the needles of the first and second group of needles 3 and 4 can increase or decrease at each change of direction of the needle-bearing cylinder. As represented in FIG. 7 the needles of the first and second group of needles, during the formation of the upper, realize a heel-counter cover 70 adapted to cover the presence of any reinforcements made on the heel zone that could be inserted manually after the creation of the upper itself.

The heel-counter can, for example, cover the collar start zone of the upper to improve the aesthetics and/or increase the abrasion resistance of the collar itself. During the formation of the heel-counter cover 70 the needles of the first group of needles are in a drop stitch position and take the yarn to knit the heel-counter cover 70.

The needles of the first group of needles can increase or decrease at each change of direction of the needle-bearing cylinder according to the dimensions to be given to the heel-counter cover.

During this step, the needles of the second group of needles 4 are in a missed or bridle position and do not take part in the creation of the heel-counter cover.

Figure 8:
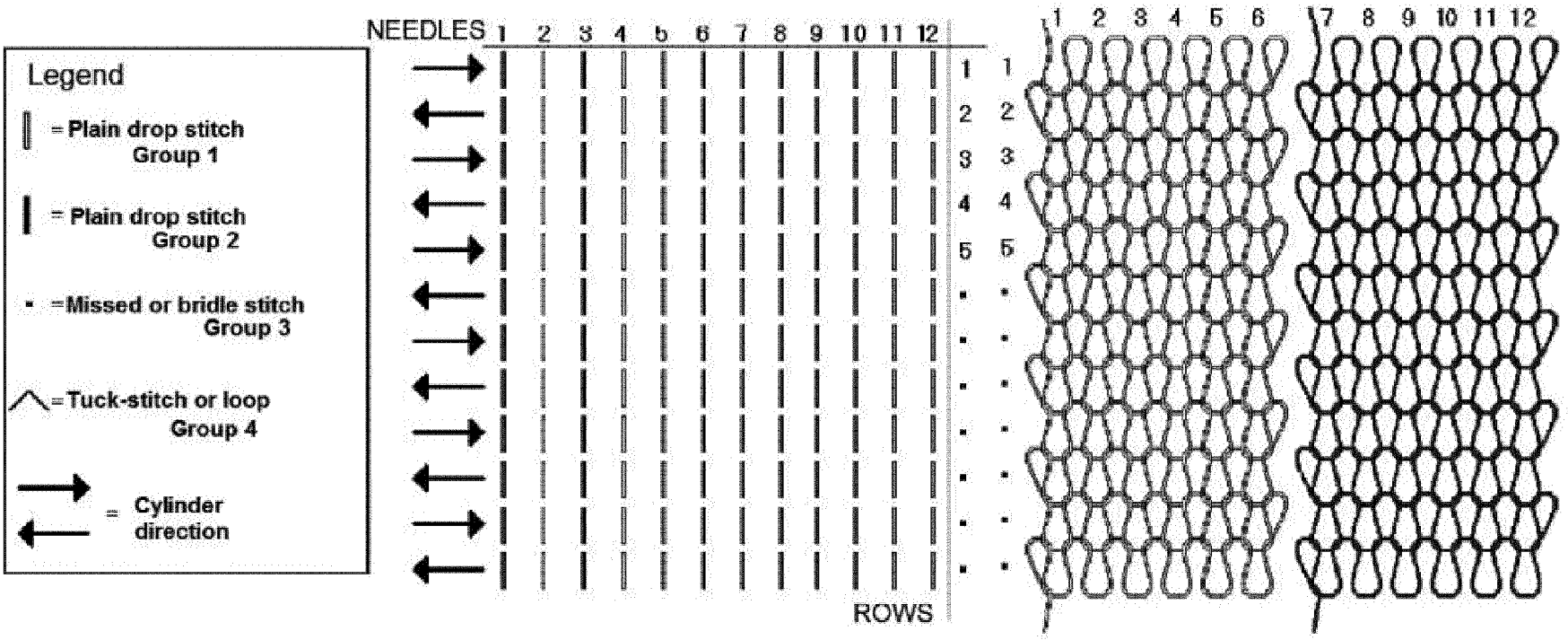
FIG. 8 is a perspective schematic view of the knitting process and of the needles used for the formation of the knitted item during the realization of additional holes according to the present invention.

As represented in FIG. 8 the needles of the first and second group of needles, during the formation of the upper, realize additional holes 80 that are used for anchoring the upper to the sole 6 or are also used for any internal lining 81 of the upper itself.

In this case the needles of the first group 3 rise to take the yarn and create the left-hand process of the additional hole by selecting a first pre-chosen needle while the needles of the second group 4 rise to take the yarn of the right-hand process starting from the needle subsequent to the first pre-chosen needle until a second pre-chosen needle subsequent to the first, (FIG. 8).

Figure 9:
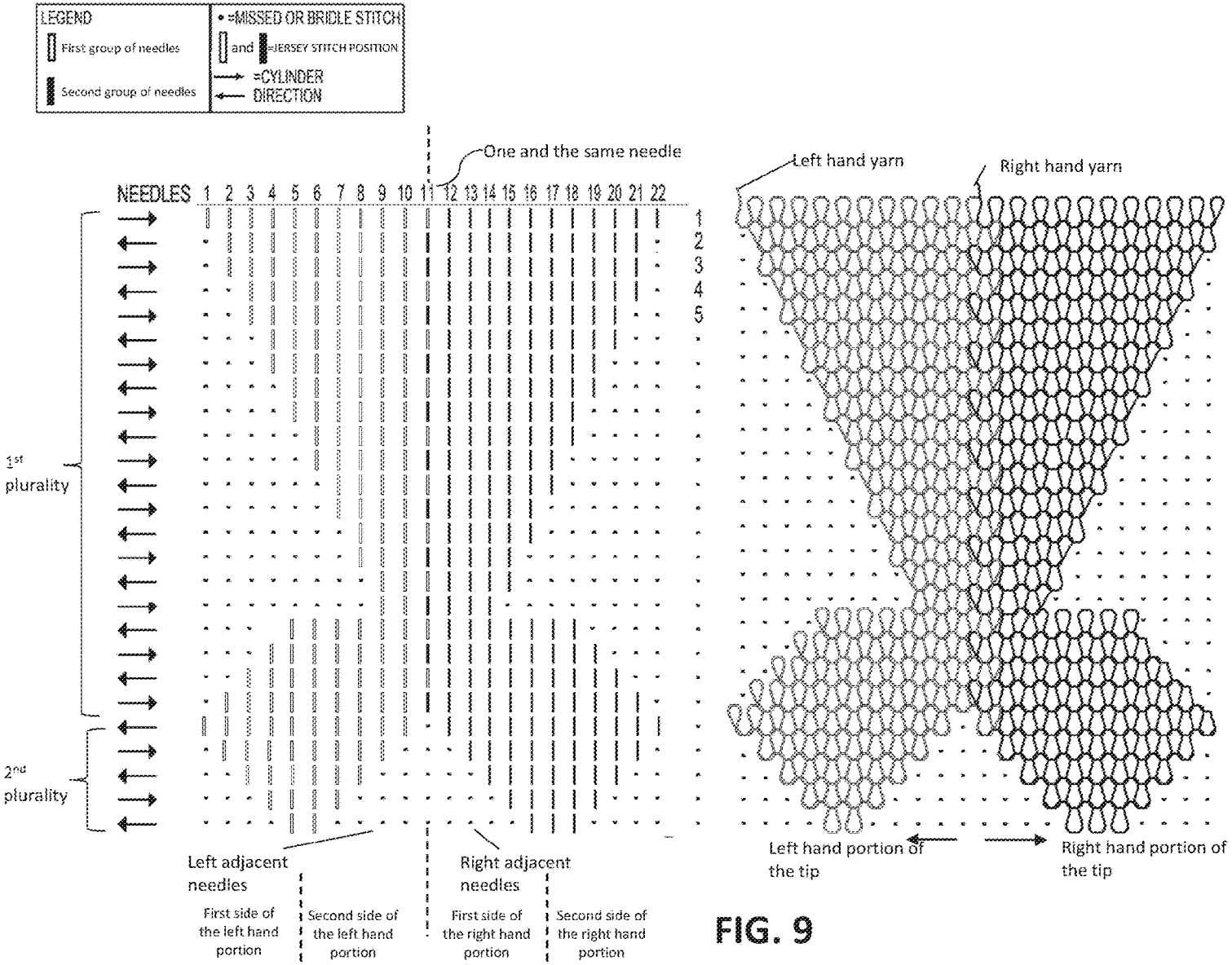
FIG. 9 is a perspective schematic view of the knitting process and of the needles used for the formation of the knitted item during the realization of an opening for arranging the seam at the axis of the sole according to the present invention.
Figure 10:
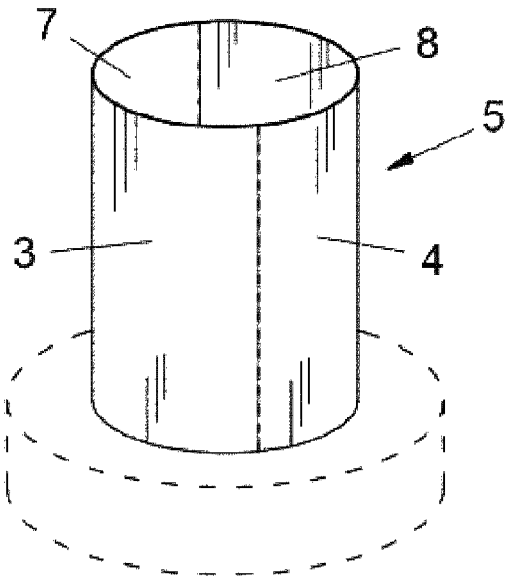
FIG. 10 is a schematic perspective view of the needle-bearing cylinder according to the present invention.
Figure 11:
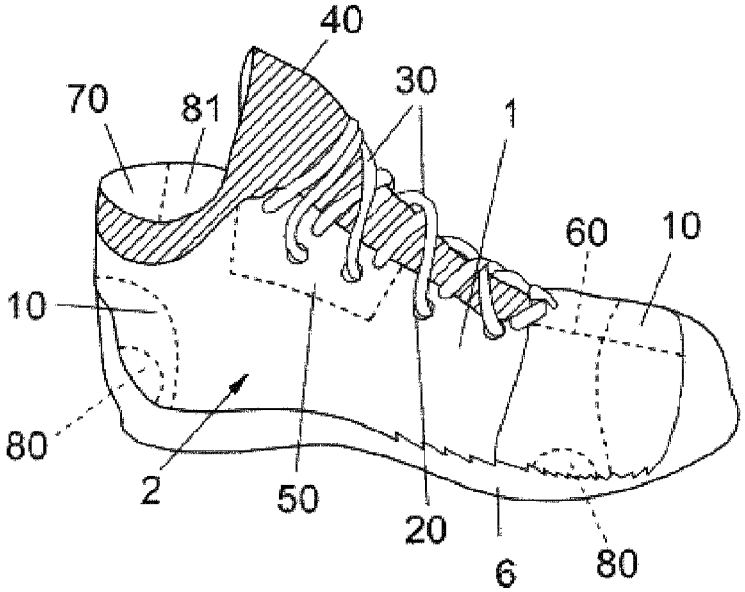
FIG. 11 is a schematic perspective view of the shoe and of the upper according to the present invention.
Figure 12:
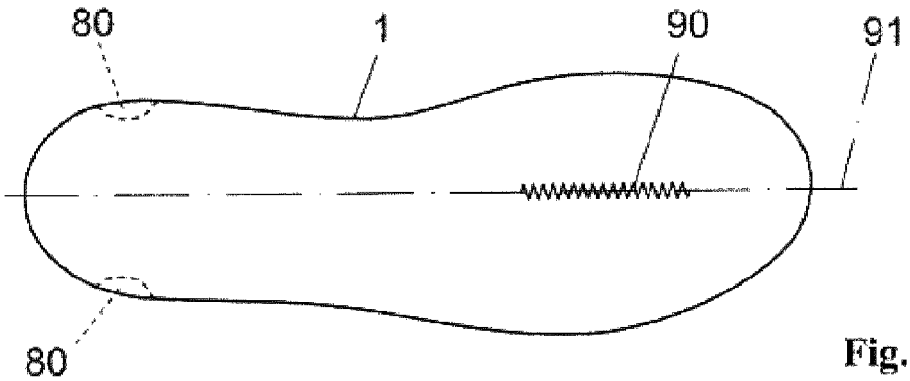
FIG. 12 is a plan view of the upper according to the present invention.

As shown in FIG. 9 the needles of the first and second group of needles, during the formation of the upper, realize a preparation for arranging a seam 90 of the tip of the upper aligned with the axis 91 of the sole itself as the number of needles can increase or decrease at each change of direction of the needle-bearing cylinder 5.

In particular, in the conclusive part of the upper an open mouth remains, which must be sewn using a sewing machine or a linking machine.

Thanks to the process according to the present invention in which, as can be seen, the needles of the first and of the second group of needles can increase or decrease at each change of direction, it is possible to realize the pouches of the tip that have a direction aligned with the sole 6 of the shoe 2.

In this way, as can be easily understood, when the upper 1 is connected to the sole 6 the seam 90 will be totally hidden and covered by the sole guaranteeing a perfect aesthetic effect for the shoe.

The formation of a mouth aligned with the axis of the sole requires a first and second group of needles.

The first group of needles follows the right-hand side of the tip of the upper and the second group the left-hand side.

The needles of both groups can increase or decrease as can be seen in FIG. 9 at each change of direction of the needle-bearing cylinder according to the dimensions of the pouch and the direction of the mouth that must then be closed.

In all the processes described above, it is always possible to use further groups of needles each in a tuck-stitch or loop position to vary the resistance of the knitted item for example to abrasion. Also in this further group of needles, the latter can increase or decrease at each change of direction of the needle-bearing cylinder. Thanks to the process according to the invention, it is also possible to realize a double upper or counter-upper.

In particular, such solution can be obtained through a doubling in series by inverting the first part from the tip to the ankle and leaving the second part unchanged from the ankle to the tip of the various processes described above, realizing two uppers connected to each other which in the assembly step will be inside each other.

The internal upper protects the foot and the external one can assume the technical and aesthetic characteristics required.

Not least, it is also possible to realize an open upper by inverting the order of the processes described. In this case the upper remains open and after the knitting it is connected directly to the sole.

The subject matter of the present invention is also an upper for shoes performed according to one or more of the steps of the process described above.

In fact, the upper for shoes according to the invention has, according to requirements, one or more of the characteristics according to the process described above.

The process for realizing an upper for shoes according to the invention is susceptible to many modifications and variations, all falling within the scope of the inventive concept; furthermore, all the details are replaceable by technically equivalent elements.

The materials used, as well as the dimensions, can be any according to the needs and the state of the art.

The invention claimed is:

1. A process for realizing a tip of an upper for shoes, comprising the steps of:

using at least a first group and a second group of needles of a needle-bearing cylinder of a circular knitting machine to respectively knit a left hand portion of the tip using a left hand yarn and a right hand portion of the tip using a right hand yarn, each needle of said first group and of said second group of needles being used in a jersey stitch position and/or in a missed stitch position at least during a forward rotation of said needle-bearing cylinder, wherein a joining between the left hand portion of the tip and the right hand portion of the tip is made by one and the same needle in the jersey stitch position, the one and the same needle passing from the first group to the second group, or vice versa, the needle-bearing cylinder performing at least a first plurality of alternate forward and return rotations at each change of rotation direction of said needle-bearing cylinder, wherein with said first and second group of needles, during the formation of the tip of the upper, realizing at least one opening for arranging a seam of the tip of the upper aligned with an axis of a sole to which the upper is to be anchored, said at least one opening longitudinally developing in the area of the upper delimited by the sole along a center line axis of said area oriented from the tip to a heel of the upper and wherein said at least one opening is obtained with said one and the same needle in the missed stitch position at each change of rotation direction of said needle-bearing cylinder when the needle-bearing cylinder performs a second plurality of alternate forward and return rotations and with respective needles of the first group and the second group of needles that are adjacent to the one and the same needle and are in the missed stitch position, wherein, when the second plurality of the alternate forward and return rotations is performed, the number of needles in the jersey stitch position decreases and the number of needles in the missed stitch position on both sides of the left hand portion of the tip and on both sides of the right hand portion of the tip increases.

2. A method for realizing a tip of an upper for shoes, comprising the steps of:

using at least a first group and a second group of needles of a needle-bearing cylinder of a circular knitting machine to respectively knit a left hand portion of the tip using a left hand yarn and a right hand portion of the tip using a right hand yarn, each needle of said first group and of said second group of needles being used in a jersey stitch position and/or in a missed or bridle stitch position at least during a forward rotation of said needle-bearing cylinder, wherein a joining between the left hand portion of the tip and the right hand portion of the tip is made by one and the same needle in the jersey stitch position, the one and the same needle passing from the first group to the second group, or vice versa, at each change of rotation direction of said needle-bearing cylinder, the needle-bearing cylinder performing at least a first plurality of alternate forward and return rotations, wherein with said first and second group of needles, during the formation of the tip of the upper, realizing at least one opening for arranging a seam of the tip of the upper aligned with an axis of a sole to which the upper is to be connected, said at least one opening longitudinally developing in the area of the upper delimited by the sole along a center line axis of said area oriented from the tip to a heel of the upper and wherein said at least one opening is obtained with said one and the same needle in the missed or bridle stitch position at each change of rotation direction of said needle-bearing cylinder when the needle-bearing cylinder performs a second plurality of alternate forward and return rotations and with respective needles of the first group and the second group of needles that are adjacent to the one and the same needle and are in the missed or bridle stitch position, wherein, when the second plurality of the alternate forward and return rotations is performed, the number of needles in the jersey stitch position decreases and the number of needles in the missed or bridle stitch position on both sides of the left hand portion of the tip and on both sides of the right hand portion of the tip increases.

3. The method according to claim 2, wherein said upper is connected to the sole, and the seam is covered by the sole.

4. The method according to claim 2, further comprising the step of: connecting said upper to the sole, wherein the seam is hidden by the sole.

* * * * *